United States Patent [19]

Andrews

[11] Patent Number: 4,601,642

[45] Date of Patent: Jul. 22, 1986

[54] HYDRAULIC PRESSURE INTENSIFIER

[75] Inventor: Robert S. Andrews, St. Peters, Mo.

[73] Assignee: The United States of America as represented by the Secretary of the Air Force, Washington, D.C.

[21] Appl. No.: 782,630

[22] Filed: Oct. 1, 1985

[51] Int. Cl.[4] ..... F04B 17/00

[52] U.S. Cl. ..... 417/225; 417/349

[58] Field of Search ..... 417/225, 349, 392

[56] References Cited

U.S. PATENT DOCUMENTS

| | | | |
|---|---|---|---|
| 2,539,292 | 1/1951 | Anderson | 230/52 |
| 2,631,542 | 3/1953 | Groves | 103/51 |
| 2,864,313 | 12/1958 | Dawson | 103/51 |
| 2,911,263 | 11/1959 | Hill | 303/6 |
| 2,925,782 | 2/1960 | Sharpe et al. | 417/392 X |
| 3,632,230 | 1/1972 | Ueda | 417/349 |
| 4,077,746 | 3/1978 | Reynolds | 417/225 |

*Primary Examiner*—Richard E. Gluck

*Attorney, Agent, or Firm*—Donald J. Singer; Stanton E. Collier

[57] ABSTRACT

A hydraulic pressure intensifier is used to raise the pressure in an accumulator above a given input pressure. An oscillating piston provides a boost pressure while a pilot valve and a dump valve and restrictors allow the oscillating piston to move.

4 Claims, 1 Drawing Figure

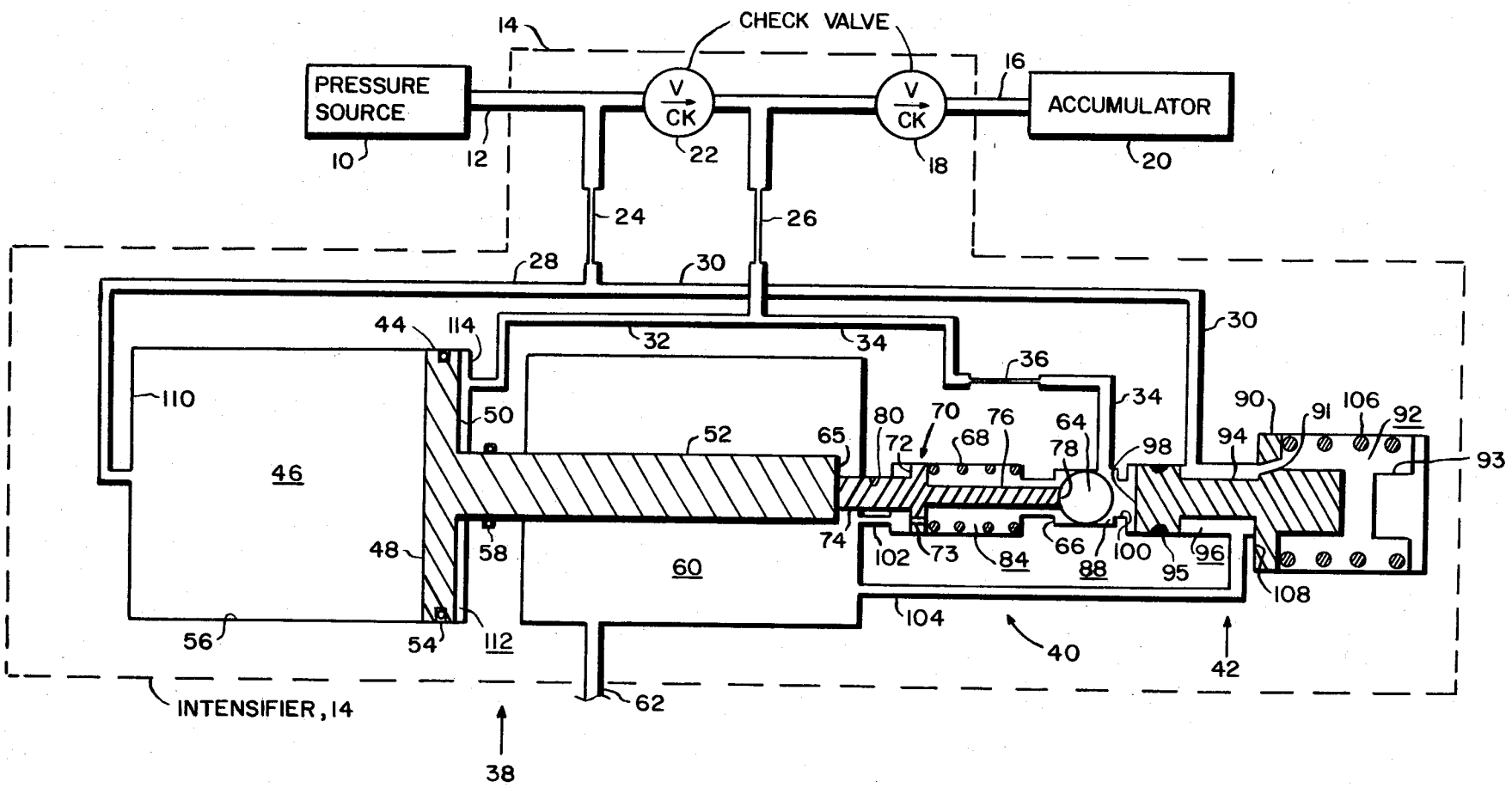
ACCUMULATOR
PRESSURE SOURCE
CHECK VALVE
INTENSIFIER, 14

HYDRAULIC PRESSURE INTENSIFIER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to hydraulic systems, and in particular, relates to hydraulic intensifiers that feed hydraulically powered devices.

In fighter aircraft, for example, hydraulic pressure is used to start the auxiliary power units which are used to start the jet engines. A pressure of about 3000 PSI was used in the past in the secondary power start accumulator but this resulted in burnt turbine blades during start up because of low energy starts due to under serviced accumulators.

The present invention is directed toward providing a pressure intensifier to boost the pressure in the secondary power start accumulator and thus eliminate the problem of burnt blades due to low energy starts.

SUMMARY OF THE INVENTION

The instant invention sets forth a hydraulic pressure intensifier that overcomes the problem noted above.

The present invention has about a 3000 PSI hydraulic input line into an intensifier. An output line thereof outputs a boost pressure at periodic intervals until a designated high pressure determined by the differential areas of the piston driver such as 4000 PSI is reached in an accumulator at which time the intensifier stalls out.

The input line enters a first one-way check valve and a first restrictor. The output line of the first one-way valve enters into a second restrictor and a second one-way check valve. The output line from the intensifier comes from the second one-way check valve.

The intensifier has basically a differential area piston driver, a pilot valve and restrictors, and a dump valve connected together as to be described. The piston driver has a piston having two sides of different areas. The smaller area providing the boost pressure to the hydraulic fluid in a boost cavity. The first resistor has a first and second downstream branch line. The first branch line is connected to a piston cavity having the larger piston area therein, and the second branch line is connected to the dump valve. The second resistor also has a first and second downstream branch line. The first branch of the second resistor connects to the boost cavity having the smaller area of the piston therein, and the second branch is connected to the pilot valve through a restrictor in the second branch line. The dump valve has a return line connected to a vent line. The pilot valve has an input from the second branch line. This input is in fluid contact with the dump valve. The pilot valve has a return line which is connected to the same vent line as the dump return. The pilot valve has a check ball that is activated by a shaft of the piston of the driver.

The dump valve under no load is held open by a spring therein and the piston in the piston driver then moves left from flow through the second restrictor to the boost cavity. Flow from the large area of the piston, the piston cavity, and the first restrictor goes to the return line through the dump valve which is being held open because of no boost pressure. After the piston bottoms out at the left, pressure builds up to 3000 PSI in the pilot cavity which is in fluid contact with the dump valve and then the dump valve moves right to a closed position. With the dump valve closed, pressure builds up on the large area of the piston and the piston then moves right; the boost pressure created by the small area of the piston holds the dump valve closed. The boost pressure is fed to a second check valve before output. The first check valve also prevents the boost pressure from backing up into the lower pressure source. When the piston bottoms out right, boost flow stops and the piston shaft moves the pilot valve open. With the pilot valve open, pressure is removed from the pressure operated dump valve and then the dump valve goes to its open position. With the dump valve open, pressure from the large area of the piston and the first restrictor is dumped and the piston again moves left (no load). As the piston moves left, the piston shaft retracts and the pilot valve goes to a closed position. The unit repeats the above cycle until boost pressure allows the piston to stall out at about 4000 PSI out and 3000 PSI in.

It is therefore one object of the present invention to provide a hydraulic pressure intensifier for an aircraft accumulator.

It is another object of the present invention to provide an intensifier that incrementally increases the pressure to a desired level.

It is a further object of the present invention to provide an intensifier that has all dynamic seals routed to a fluid return thus eliminating external dynamic seal leakage.

It is a still a further object of the present invention to provide an intensifier that has less friction due to Teflon sealing therein and thus have a longer life. Teflon can be used due to its slight inherent leakage being directed to return.

These and many other objects and advantages of the present invention will be readily apparent to one skilled in the pertinent art from the following detailed description of a preferred embodiment of the invention and the related drawings.

BRIEF DESCRIPTION OF THE DRAWING

The only FIGURE of the present invention illustrates schematically the intensifier of the present invention.

DETAILED DESCRIPTION OF THE PREFERRED EMBODIMENT

Referring to the only FIGURE, a high pressure hydraulic source 10 outputs a pressurized fluid to an input line 12 of hydraulic pressure intensifier 14, shown in outline. Input line 12 has a pressure of about 3000 PSI therein. Intensifier 14 outputs on an output line 16 a pressurized fluid having a pressure greater than the fluid in input line 12. The pressurized fluid in output line 16 is passed through a one-way check valve 18 and is stored in an accumulator 20 for future use as described hereinabove. Input line 12 is connected to a one-way check valve 22 and to a first restrictor 24. Check valve 22 is connected to check valve 18 and to a second restrictor 26. The source pressure is able to pass directly into accumulator 20 thru one-way check valves 22 and 18. Intensifier 14 increases the output pressure above the source pressure in accumulator 20. First restrictor 24 outputs into a first branch line 28 and a second branch line 30. Second resistor 26 outputs into a first branch line 32 and a second branch line 34 having therein a third restrictor 36. Unless otherwise stated, fluid may flow in either direction of a line.

Intensifier 14 further includes a piston driver 38, a pilot valve 40 and a dump valve 42 connected together as described hereinbelow.

Piston driver 38 has a piston 44 moving inside of a cylindrical piston cavity 46. Piston 44 has a first area 48 and a second area 50, second area 50 being smaller than first area 48. Second area 50 of piston 44 provides the increased pressure boost when moved to the right in a boost cavity 112. A shaft 52 attached to piston 44 acts upon pilot valve 40 by a shaft end 65 intermittently. A first seal 54 made of polytetrafluoroethylene (Teflon), for example, about piston 44 and in contact with a cavity wall 56 prevents the leakage of fluids between the different sides of piston 44. A second seal 58 prevents fluid leakage by shaft 52. A fluid return cavity 60 allows fluid to enter a vent line 62.

Pilot valve 40 has therein a check ball 64 that makes sealing contact with a seat 66. A spring 68 pushes against a flange 72 that is a part of and integral to a rod 70. Rod 70 has therein a first section 74 and a second section 76 integrally formed together. Flange 72 has a hole 73 therethrough so that fluid can flow from one side to another. An end 78 of second section 76 of rod 70 is in intermittent contact with check ball 64. First section 74 is in sliding contact with a housing hole 80 and in intermittent contact with shaft end 65. A pilot return line 102 allows fluid to move from a pilot valve cavity 84 to fluid return cavity 60 and therefrom by vent line 62. Check ball 64 moves within a pilot cavity 88 and when fluid enters from second branch line 34, check ball 64 will seat against seat 66 if not blocked by rod end 78.

Dump valve 42 has therein a spring biased pressure actuated dump piston 90 moving within a spring cavity 92. Integrally attached to dump piston 90 is a valve piston 94 moving within a dump cavity 96 in a sealed manner to prevent the passage of pressurized fluid across piston 94 past a piston face 98. Dump cavity 96 has input second branch line 30 and outputs to a dump return line 104 when in a dump position as shown in the FIGURE. A spring 106 in cavity 92 holds dump piston 90 against a stop 108 until a pressure greater than the pressure required to move piston driver 38 in an unload direction to the left is placed on piston face 98 of valve piston 94. A sufficient pressure causes valve piston 94 to move to the right against stop 93 and close off second branch line 30 to dump cavity 96 by a sealing land 95 on valve piston 94. A channel 91 through dump piston 90 allows fluid to flow between cavity 96 and cavity 92 when dump piston 90 moves.

In operation, valve piston 94 is held in the open position as shown in the FIGURE when in the no load postion. The fluid from first and second branch lines 28 and 30, respectively, passes through dump cavity 96 to dump return line 104 and to vent line 62. Since spring 106 is biased at a higher pressure than is required to move dump piston 90, dump piston 90 will not move. Since first branch line 28 is dumping when piston 44 is moving in a no load direction to the left, a lower pressure will exist on first area 48 of piston 44 of piston driver 38. Since second branch line 34 has a third restrictor 36 therein the pressure from first branch line 32 onto second area 50 will be greater than the pressure on first area 48 thereby causing piston 44 to move to the left. As this occurs, check ball 64 of pilot valve 40 will seat on seat 66 because of fluid flow from line 34 and because rod 70 moves to the left as biased by spring 68 as shaft 52 moves to the left. As this occurs piston 44 will continue to move to the left until stopped by a wall 110. Fluid from piston cavity 46 flows to vent line 62 in the process. When piston 44 "bottoms out" on wall 110, pressure in a boost cavity 112 increases to 3000 PSI and this increased pressure acts on piston face 98 of valve piston 94 of dump valve 42 causing dump piston 90 to move to the right closing off line 30 to dump cavity 96. Check ball 64 is further still held against seat 66.

The force acting on first face 48 of piston 44 is greater than the force acting against second face 50 due to face 48 having a greater area than face 50 with the same fluid pressure on both sides of piston 44. Piston 44 will thus move to the right. Since the moving force is acting on a smaller area for displacing fluid from boost cavity 112, the pressure is increased above the input pressure of 3000 PSI a given amount. This boost pressure is transmitted from boost cavity 112, through first branch line 32, through second restrictor 26, through one-way check valve 18, from output line 16 to accumulator 20. The boost pressure is held by check valve 18 in accumulator 20. Boost pressure cannot reach source 10 because of second check valve 22.

When piston 44 bottoms out on a wall 114 of boost cavity 112, boost pressure stops. As this occurs dump valve 42 opens and pilot valve 40 opens, when check ball 64 is pushed off seat 66 by rod 70 when shaft end 65 hits first section 74 of rod 70.

When the pilot valve 40 opens, boost pressure is removed from dump valve 42. When dump valve 42 opens, pressure is lowered in piston cavity 46 of pistion driver 38 and first restrictor 24. This is a no load position from which the above cycle repeats until a predesignated PSI of about 4000 PSI is held in accumulator 20. When the predesignated pressure is reached in accumulator 20, piston 44 stalls out. Accumulator 20 has an initial pressure of about 3000 PSI before intensifier 14 starts pressure boost due to the flow from pressure source 10 through check valves 22 and 18.

Clearly, many modifications and variations of the present invention are possible in light of the above teachings and it is therefore understood, that within the inventive scope of the inventive concept, the invention may be practiced otherwise than specifically claimed.

What is claimed is:

1. A pressure intensifier, said intensifier having input a fluid at a given pressure from a pressure source and outputting a fluid at a boosted pressure to an accumulator, said accumulator reaching therein a predesignated pressure before said intensifier ceases operation, said intensifier comprising:

a first check valve, said first check valve having an input line and an output line, said input line receiving pressurized fluid from said pressure source;

a second check valve, said second check valve having an input line for receiving pressurized fluid from said output line of said first check valve, said second check valve outputting pressurized fluid to said accumulator from an output line of said second check valve;

a first restrictor, said first restrictor connected to said first check valve input line and outputting pressurized fluid in a first branch line and a second branch line of said first restrictor;

a second restrictor, said second restrictor connected to said output line of said first check valve of said intensifier and connected to a first branch line and a second branch line of said second restrictor, said second restrictor being connected to said input line of said second check valve;

a piston driver, said piston driver connected to said first branch line of said first restrictor and to said first branch line of said second restrictor, said piston driver repeatedly outputting said boosted pressure until said predesignated pressure is achieved in said accumulator;

a pilot valve, said pilot valve in periodic contact with an extension of said piston driver for opening and closing said pilot valve, said pilot valve connected to said second branch line of said second restrictor and having a pilot return line connected to a vent line; and a dump valve, said dump valve connected to said second branch line of said first restrictor, said dump valve having a dump return line connected to said vent line, and said dump valve in fluid communication with said pilot valve.

2. A pressure intensifier as defined in claim 1 wherein said piston driver comprises:

a piston cavity being a cylindrical bore having a first end wall and a second end wall;

a fluid return cavity, said fluid return cavity having said vent line, said pilot return line connected thereto, and said dump return line connected thereto; said first end wall of said fluid return cavity having therein a shaft bore, and said second end wall of said fluid return cavity having therein a rod bore; and a piston with a shaft, said piston oscillating in a sealed manner between said first and said second wall of said piston cavity, said shaft positioned in said shaft bore of said dump cavity and oscillating in a sealed manner, said piston having said piston cavity contacting a first face of said piston, said first branch line of said first restrictor connected to said piston cavity; said piston having a boost cavity contacting a second face of said piston, said second face having a smaller area than said first face, said boost cavity being connected to said first branch line of said second restrictor; said shaft of said piston extending through said dump cavity to be in periodic contact with said pilot valve.

3. A pressure intensifier as defined in claim 2 wherein said pilot valve comprises:

a rod, said rod having a first section, a second section, and a flange about said first section, said flange in sliding contact with a cylindrical cavity, said flange having a fluid passage therethrough;

a biasing spring, said spring positioned in said cylindrical cavity of said pilot valve and in contact with said flange and an end wall of said cylindrical cavity, said first section in periodic contact with an end of said shaft of said piston driver; and a check ball positioned in a pilot cavity having said second branch line of said second restrictor therein, said check ball in periodic contact with said second section of said rod, and said pilot cavity in fluid communication with said dump valve, said pilot return line connected to said cylindrical cavity such that fluid can pass through said pilot cavity and said cylindrical cavity to said pilot return line.

4. A pressure intensifier as defined in claim 3 wherein said dump valve comprises:

a piston valve;

a dump cavity;

said piston valve translating in a sealed manner in said dump cavity, said piston valve having a piston face that is in fluid contact with said pilot valve, said dump cavity being connected to said second branch line of said first restrictor and to said dump return line, said piston valve intermittently closing said second branch line of said first restrictor;

a dump spring cavity;

a dump piston, said dump piston being spring biased and integrally bearing on to a piston flangé, said dump piston being in sliding contact with said dump spring cavity; and a dump spring, said dump spring being positioned in said dump spring cavity and biasing said dump piston against said piston stop until a given pressure is applied to said piston face of said piston valve by fluid from said pilot valve.

* * * * *